US006299488B1

(12) United States Patent
Lin

(10) Patent No.: US 6,299,488 B1
(45) Date of Patent: Oct. 9, 2001

(54) SIMPLIFIED SOCKET STRUCTURE OF MINIATURE LIGHT BULB SETS

(75) Inventor: Jian Ji Lin, Hsinchu (TW)

(73) Assignee: Kuo-Fen Shu, Hsinchu (TW)

( * ) Notice: Subject to any disclaimer, the term of this patent is extended or adjusted under 35 U.S.C. 154(b) by 0 days.

(21) Appl. No.: 09/597,720

(22) Filed: Jun. 19, 2000

(51) Int. Cl.[7] ..... H01R 1/00
(52) U.S. Cl. ..... 439/619; 362/249
(58) Field of Search ..... 439/619, 699.2, 439/736; 362/226, 249

(56) References Cited

U.S. PATENT DOCUMENTS 5,331,529 * 7/1994 Huang ..... 362/226
5,620,343 * 4/1997 Pan ..... 439/699.2
6,074,073 * 6/2000 Huang ..... 362/226
6,142,646 * 11/2000 Liu ..... 362/226

* cited by examiner

*Primary Examiner*—Gary Paumen
*Assistant Examiner*—P Nguyen
(74) *Attorney, Agent, or Firm*—Rosenberg, Klein & Lee

(57) ABSTRACT

A simplified socket structure of miniature light bulb sets primarily comprises a shell element and a holding element that is provided with a pair of opposite resilient arms to secure a miniature light bulb in position. When the holding element along with a miniature light bulb seated therein is inserted into the shell element, the resilient arms are urged by the walls of the shell element to move toward each other to firmly grasp the light bulb. Thus the miniature light bulb socket according to the invention has the advantages of simplified structures and promoted gripping effect.

1 Claim, 4 Drawing Sheets

SIMPLIFIED SOCKET STRUCTURE OF MINIATURE LIGHT BULB SETS

SUMMARY OF THE INVENTION

Average miniature light bulb sets mainly comprise a miniature light bulb seated in a socket that is composed of a holding element and a shell element. The holding element of a prior art socket structure is provided with a receiving portion and an insertion portion; the receiving portion accommodating a light bulb and the insertion portion being housed in the shell element. Both portions have fixed shapes. If the size of the receiving portion is too large, the holding element can not firmly secure a light bulb. On the other hand, if the size of the receiving portion is too small, it is hard to insert a light bulb. Besides, such structure needs more material to build and so it affects product weight. Thus it is not cost effective.

In view of these problems, the object of the invention is to provide a simplified miniature light bulb socket structure that makes use of a specially designed holding element in conjunction with a shell element to provide a better grasping effect while the structural material is reduced. Now the features and advantages of the invention will be enumerated with reference to the accompanying drawings.

BRIEF DESCRIPTION OF THE ACCOMPANYING DRAWINGS

DETAILED DESCRIPTION OF THE INVENTION

Figure 1:
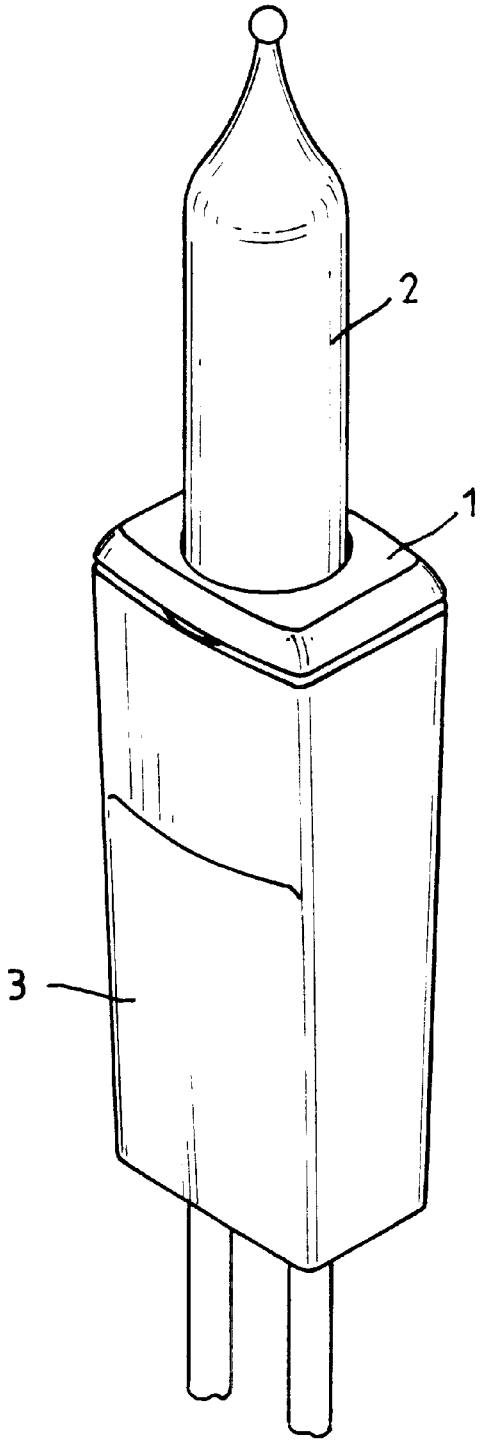
FIG. 1 is a perspective view showing the outer appearance of a miniature light bulb set according to the invention.
Figure 2:
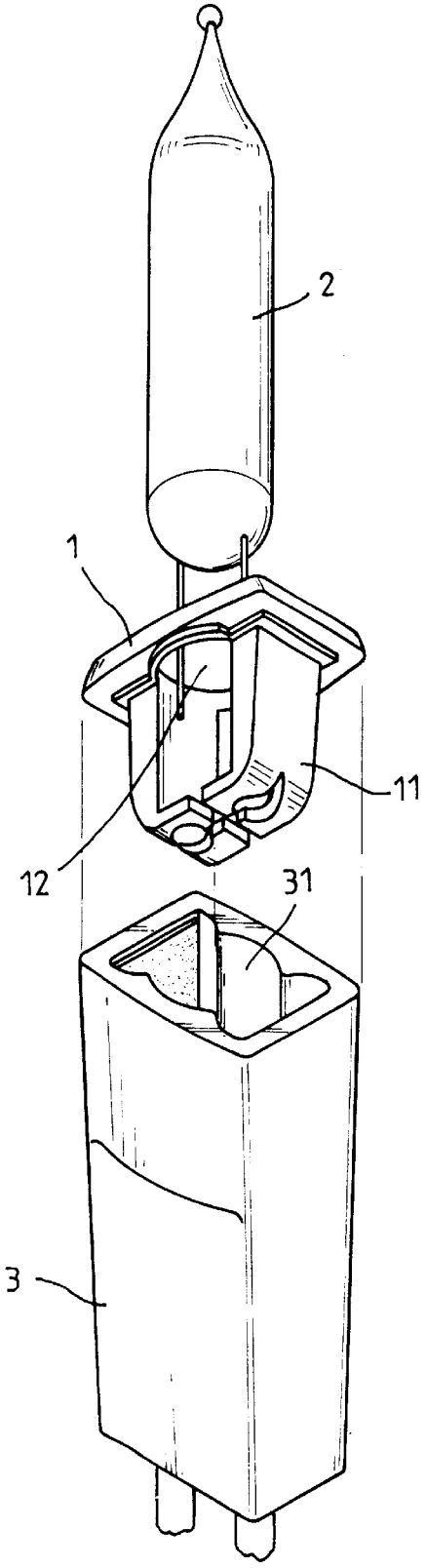
FIG. 2 is an exploded view of the miniature light bulb set of FIG. 1.
Figure 3:
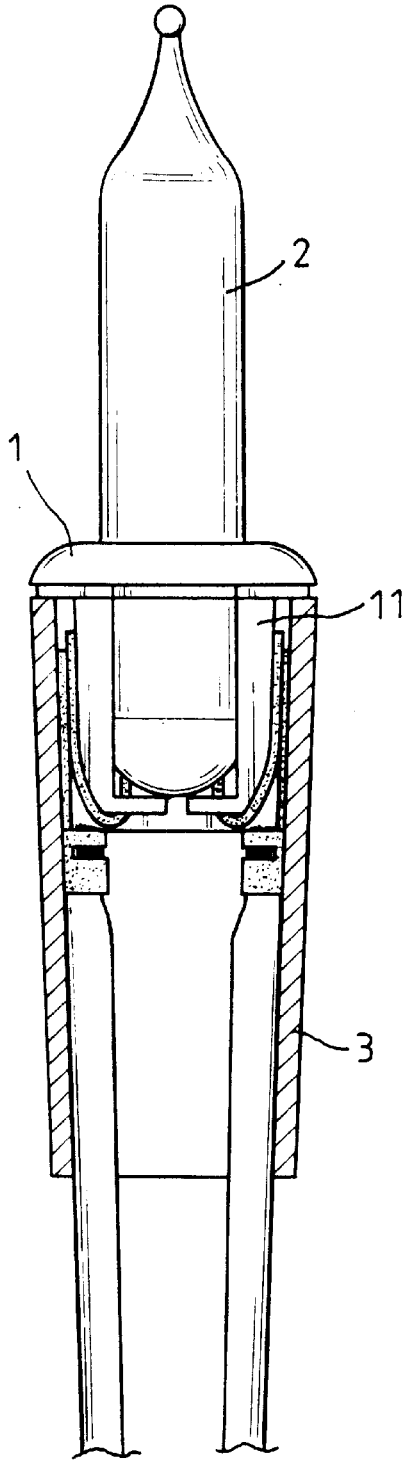
FIG. 3 is a cross sectional view showing the miniature light bulb set of FIG. 2 in an assembled state.

Referring to FIGS. 1 through 3, a miniature light bulb socket according to the invention comprises an improved light bulb holding element (1) and a shell element (3) having an opening (31). The light bulb holding element (1) associated with a miniature light bulb (2) seated therein is further inserted into the opening (31) of the shell element (3). This present invention is featured by the configuration of the holding element (1) that has a pair of opposite resilient arms (11) disposed on the lower portion thereof. When a miniature light bulb (2) is placed into the socket of the invention, its lower end passes through the central hole (12) of the holding element (1) and is located between two arms ( 11). When the holding element (1) with a light bulb is further inserted into a shell element (3), the walls of the opening (31) of the shell element (3) urge the resilient arms (11) to move to each other to firmly embrace the miniature light bulb (2). In this way the socket of the invention can apply a greater holding force on light bulbs (2), producing forceful combination.

Figure 4:
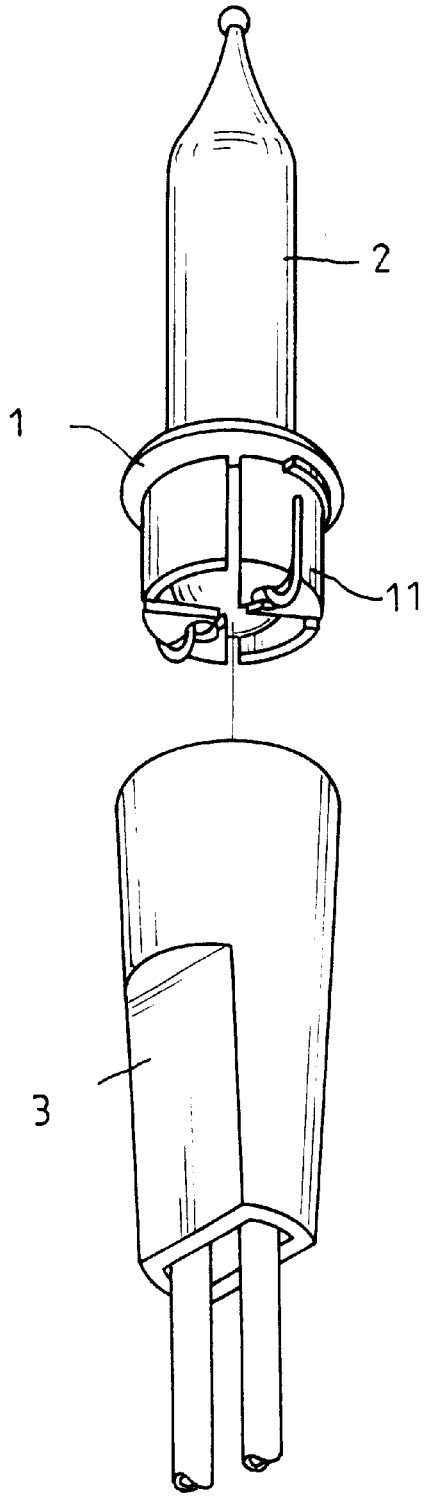
FIG. 4 shows an exemplary variant of the miniature light bulb set of FIG. 1.

From the above description, the invention makes use of resilient arms (11) to secure light bulbs (3) and further utilizes a shell element (3) to constrain the light bulb (3) in position. Thus it can reach better connection. In addition, due to the simplified resilient arm structure the materials used on a holding element (1) are less in comparison with a conventional structure and thus a socket according to the present invention has a better economical effect. In brief, the design of the invention indeed has the essence of a patent and so it is eligible for a patent grant. It is to be understood that while the invention has been described with respect to preferred embodiments thereof, modifications may be made within the scope of the invention. For instance, a four-claw mechanism can be used for; substitution for the resilient arms of the holding element as shown in FIG. 4. Such a structure can also achieve the same gripping effect.

What is claimed is:

1. A simplified socket structure comprising:

a miniature light bulb;

a holding element having a first opening for receiving said miniature light bulb therein and a pair of resilient arms disposed on opposing sides of said first opening and extending from a lower portion thereof, a portion of said miniature light bulb extending between said pair of resilient arms; and, a shell element having a second opening for receiving said resilient arms and said portion of said miniature lamp therein, said resilient arms being urged toward one another to engage said portion of said miniature light bulb when said resilient arms are received in said shell element.

* * * * *